United States Patent [19]

Dowse

[11] 4,081,970

[45] * Apr. 4, 1978

[54] UNDERWATER STRUCTURE

[75] Inventor: Brian Edward Wesley Dowse, Ontario, Canada

[73] Assignee: Golder Hoek and Associates Limited, Maidenhead, England

[ * ] Notice: The portion of the term of this patent subsequent to Mar. 1, 1994, has been disclaimed.

[21] Appl. No.: 779,801

[22] Filed: Mar. 21, 1977

[30] Foreign Application Priority Data

Mar. 23, 1976 United Kingdom ..... 11588/76
May 13, 1976 United Kingdom ..... 19878/76

[51] Int. Cl.[2] ..... E02D 27/22; E02D 27/52

[52] U.S. Cl. ..... 61/88; 61/5; 61/50

[58] Field of Search ..... 61/1 R, 50, 52, 86, 61/87, 103, 88, 4

[56] References Cited

U.S. PATENT DOCUMENTS 3,855,803 12/1974 Lacroix ..... 61/88
4,009,580 3/1977 Dowse ..... 61/88

FOREIGN PATENT DOCUMENTS 1,136,178 12/1968 United Kingdom ..... 61/50

*Primary Examiner*—Paul R. Gilliam
*Assistant Examiner*—A. Grosz

[57] ABSTRACT

A method of forming an underwater structure which includes fabricating an assembly consisting of an upper deck section, a lower gravity section and an impervious member secured in water-tight fashion to the lower peripheries of the deck and gravity sections. The assembly is floated with the membrane in a folded condition to the site and lowered so that the gravity section rests on the sea or river bed. The space between the sections and the membrane is filled with water and a non-settable particulate material to form a body of such material. The particulate body is drained to enable the external water pressure to exert a confining pressure on the body to render it coherent.

7 Claims, 4 Drawing Figures

UNDERWATER STRUCTURE

This invention relates to underwater structures, and in particular to modifications of the underwater structure described and claimed in our copending application now U.S. Pat. No. 4,009,580, the modified structures being suitable for protecting underwater installations such as subsea completion units at oil well heads.

Figure 1:
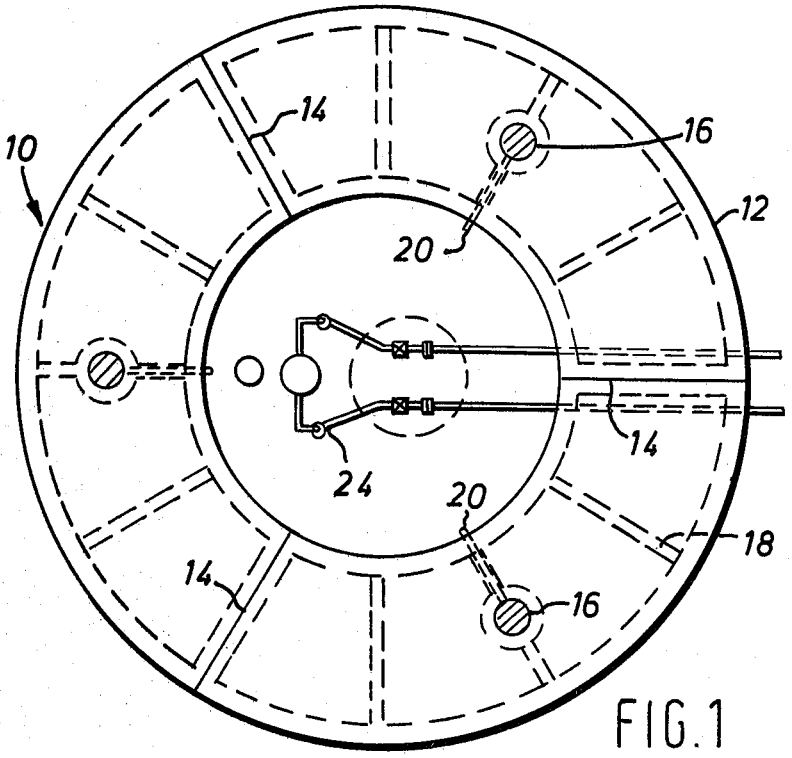
Figure 2:
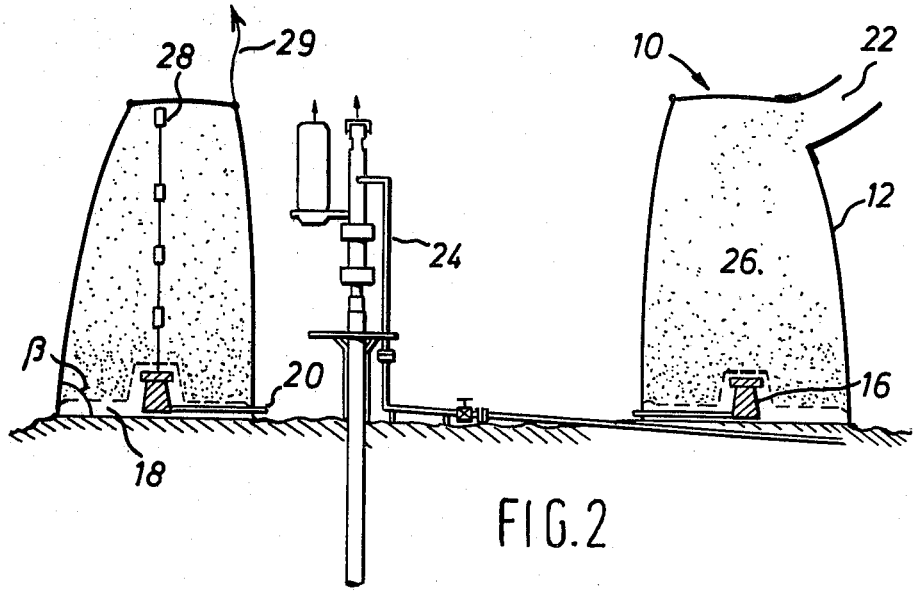
Figure 3:
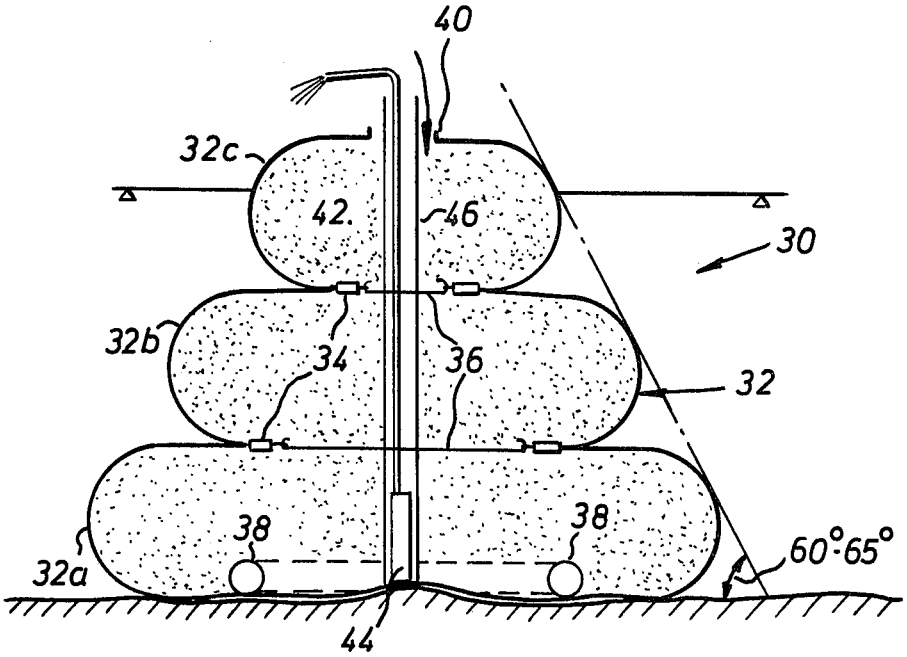
Figure 4:
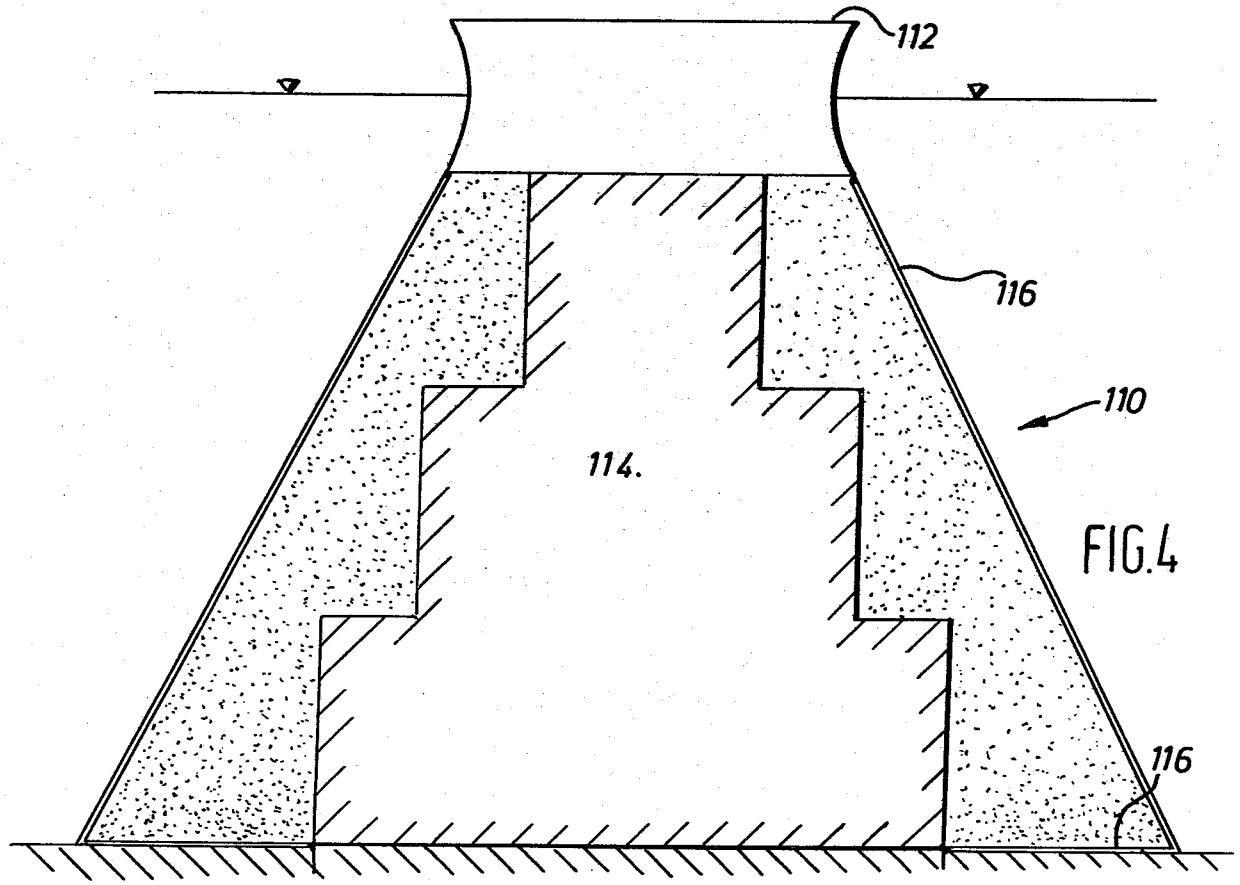

Embodiments of the invention will now be described by way of example only with reference to the accompanying drawings, in which:

FIG. 1 is a top plan of an underwater structure according to the invention and used to protect a subsea completion unit at an oil well head, FIG. 2 is a vertical cross-section through the structure of FIG. 1, FIG. 3 is a diagrammatic transverse section through another embodiment of underwater structure according to the invention and in the form of a breakwater, and FIG. 4 is a diagrammatic longitudinal section through a further embodiment of underwater structure according to the invention.

Referring to FIGS. 1 and 2 of the drawings, the underwater structure 10 comprises a toroidal membrane 13 which is fabricated on land and then transported in a collapsed condition to the site. The interior of the membrane may be subdivided into a number of compartments by radially extending separate walls 14. On the inner surface of the base of the membrane are secured a plurality of submersible pumps 16 having inlets in communication with a drainage network consisting of perforated pipes 18; the outlets of the pumps are connected by non-perforated tubes 20 to be outside of the membrane. At the site location, the membrane is inflated by pumping water into its interior through one or more inlets 22. The inflated membrane is then sunk to the sea bed so as to surround the underwater installation, which in this case (see FIG. 2) is a subsea completion unit 24 at an oil well head. A sand and water mixture is then fed to inlets 22 to build up a sand body 26 within the membrane. During and after the sand/water feed operation, water is removed from the sand body by pumps 16 and directed via tubes 20 to the outside of the membrane. By drawing water from the sand body, build up of pore water pressure in the sand is reduced and this in turn maintains at a suitable level the internal shear strength of the partially drained sand body under the confinement of the natural hydrostatic pressure acting on the outside of the membrane, thereby enabling the underwater structure to effectively withstand external forces resulting for example from trawl wires or anchors being dragged.

To sense the progress of forming the sand body, the interior of the membrane may be provided with a piezometer stack 28 which monitors to the surface reduced internal pressure during filling; systems control for the pumps and stack readout is enabled through cable 29.

The optimum value of the vertical angle $\beta$ of the membrane will probably be between 30° and 70°.

If a permanent structure is required, a hardening agent such as cement would be fixed with sand/water mixture; in this case, the pumps would be disconnected after the membrane filling operation.

Referring to FIG. 3, a breakwater structure 30 comprises an elongate membrane 32 perhaps 100 meters or longer which when inflated has a cross-sectional shape consisting of a series of (in this case three) bulbous sections 32*a*, 32*b* and 32*c*, of progressively smaller area. The sections are determined by opposed pairs of clamps 34 secured to the inner side walls of the membrane and connected together by chains or ropes 36. Within the lowermost section is a continuous perforated flexible drain 38 attached to the base of the membrane, and manhole openings 40 are provided in the top section at regular intervals.

The above described membrane would be transported to the site is rolled form and would be unrolled into position behind a boat. The membrane is first inflated with water so that the bottom rests on the seabed and the top rises above the water surface, and then with a sand/water mixture to build up a coherent sand body 42 within the membrane. Water draining into the flexible drain 38 is pumped by submersible pump 44 away from the breakwater structure through collector pipes 46 extending from the flexible drain through openings 40 to the outside. After body 42 is formed the manhole covers may be sealed or can be replaced and a simple wind operated pump left to take away any further water entering drain 38.

The above described structure allows for temporary positioning of the breakwater to ascertain its effect of external sand and shore movement. If an adverse effect is found, the breakwater can be emptied by pumping out its sand fill and reassembled in a different position. If there is no adverse effect, the sand fill can be grouted with any type of cementing agent if required to provide a permanent structure requiring little or no maintenance.

To increase the length of the breakwater, a number of the above described structures may be butt jointed together.

The membrane may have any number of sections (from 2 up) so long as a side slope (that is the slope of a common tangent line touching the sections) is maintained between 60° and 70°.

Referring to FIG. 4, the first stage in the manufacture of the underwater structure is to fabricate on land and/or water an assembly 110 consisting of an upper deck section 112, a conventional concrete of steel gravity section 114 and a prefabricated impervious membrane 116 secured in water tight fashion to the lower peripheries of the deck and gravity sections 117. The assembly is then floated with the membrane in a folded condition to the site of the underwater structure and the assembly is lowered so that the gravity sections rests on the sea bed. Water is then pumped into the membrane to inflate it, followed by a sand and water mixture to build up a sand body 18 within the membrane. During and after the pumping operation, water draining from the sand body is removed through a suitable pump conduit (not shown). By drawing water from the sand body, build up of pore water pressure in the sand is reduced and this in turn maintains at a suitable level the internal shear strength of the partially drained sand body under the confinement of the natural hydrostatic pressure acting on the outside of the membrane, thereby enabling the underwater structure to effectively withstand large external forces resulting for example from collisions between external objects (such as icebergs) and the structure.

To facilitate draining of the sand body, the body may be composed of alternate layers of course and fine sand (as described in our application now U.S. Pat. No. 4,009,580,).

What We claim is:

1. A method of forming an underwater structure, comprising fabricating an impervious inflatable membrane to form a substantially totally enclosed container, the membrane when inflated being elongate and having a cross-sectional shape consisting of a series of superimposed bulbous sections of progressively smaller area considered in an upward direction; transporting the membrane in a collapsed condition to the site; inflating the membrane to permit or cause a base portion thereof to rest on the river or sea bed; filling the membrane with a non-settable particulate material to form a body of such material; and draining the particulate body to enable the external water pressure to exert a confining pressure on the body to render it coherent.

2. The method of claim 1, wherein the sections are determined by opposed pairs of clamp members secured to the inner walls of the membrane and connected together by tie means.

3. The method of claim 1, wherein the interior of the lowermost section is provided with a perforateddrain, and wherein a collector pipe communicates with the drain to direct water away from the interior of the membrane.

4. A method of forming an underwater structure, comprising fabricating an impervious inflatable membrane to form a substantially total enclosed container, the membrane when inflated being of toroidal shape; transporting the membrane in a collapsed condition to the site; inflating the membrane to permit or cause a base portion thereof to rest on the river or sea bed; filling the membrane with a nonsettable particulate material to form a body of such material; and draining the particulate body to enable the external water pressure to exert a confining pressure on the boyd to render it coherent.

5. The method of claim 4, wherein the interior of the membrane is provided with a piezometer stack for monitoring reductions in the internal pressure during the filling operation and hence sensing the progress of forming the particulate body.

6. The method of claim 4, wherein the radial outer surface of the membrane when inflated extends upwardly at an angle of between 30° and 70° to the horizontal.

7. A method for forming an underwater structure, comprising fabricating an assembly consisting of an upper deck section, a lower gravity section, and an impervious member secured in water-tight fashion to the lower peripheries of the deck and gravity sections; floating the assembly to the site; lowering the assembly so that the gravity section rests on the sea or river bed; filling the space between the sections and membrane with a non-settable particulate material to form a body of such material; and draining the particulate body to enable the external water pressure to exert a confining pressure on the body to render it coherent.

* * * * *

UNITED STATES PATENT AND TRADEMARK OFFICE

CERTIFICATE OF CORRECTION

PATENT NO. : 4,081,970

DATED : April 4, 1978

INVENTOR(S) : Brian Edward Wesley Dowse

It is certified that error appears in the above-identified patent and that said Letters Patent are hereby corrected as shown below:

Column 1, line 66, delete "meters" and insert therefor --metres--;

Column 2, line 1, delete "32a, 32b, and 32c" and insert therefor --32a, 32b, and 32c--;

Column 2, line 10, delete "is" and insert therefor --in--;

Column 2, line 24, delete "of" second occurrence, and insert therefor --on--;

Column 3, line 20, delete "perforateddrain" and insert therefor --perforated drain--;

Column 3, line 26, delete "total" and insert therefor --totally--;

Column 4, line 5, delete "boyd" and insert therefor --body--;

Column 4, line 17, delete "for" and insert therefor --of--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*